US009542883B2

(12) United States Patent
Lee et al.

(10) Patent No.: US 9,542,883 B2
(45) Date of Patent: Jan. 10, 2017

(54) DEVICE AND METHOD FOR CONTROLLING BRIGHTNESS OF ORGANIC LIGHT EMITTING DIODE DISPLAY

(71) Applicant: LG DISPLAY CO., LTD., Seoul (KR)

(72) Inventors: Hyun Jae Lee, Gyeonggi-do (KR); Jin-Hyoung Kim, Gyeonggi-do (KR); Jae-Sung Son, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 301 days.

(21) Appl. No.: 14/186,527

(22) Filed: Feb. 21, 2014

(65) Prior Publication Data

US 2014/0168291 A1 Jun. 19, 2014

Related U.S. Application Data

(62) Division of application No. 12/886,920, filed on Sep. 21, 2010, now Pat. No. 8,711,084.

(30) Foreign Application Priority Data

Sep. 22, 2009 (KR) ..... 10-2009-0089639

(51) Int. Cl.
*G09G 3/32* (2016.01)
*G09G 3/34* (2006.01)

(52) U.S. Cl.
CPC ..... *G09G 3/3225* (2013.01); *G09G 3/3406* (2013.01); *G09G 2320/064* (2013.01); (Continued)

(58) Field of Classification Search
CPC ..... G09G 3/13
See application file for complete search history.

(56) References Cited

U.S. PATENT DOCUMENTS 5,990,665 A * 11/1999 Kawata et al. ..... 320/162
2005/0104838 A1* 5/2005 Sasaki ..... 345/102
2006/0290718 A1* 12/2006 Ishida ..... 345/691

FOREIGN PATENT DOCUMENTS

CN 1625763 A 6/2005
CN 1885377 A 12/2006
(Continued)

OTHER PUBLICATIONS

Office Action issued in corresponding Chinese Patent Application No. 201010288635.8 dated Jun. 19, 2012.

*Primary Examiner* — Amare Mengistu
*Assistant Examiner* — Shawna Stepp Jones
(74) *Attorney, Agent, or Firm* — Morgan, Lewis & Bockius LLP

(57) ABSTRACT

A device and a method for controlling brightness of an OLED display device are disclosed.
The method for controlling brightness of an OLED display device includes the steps of forwarding external brightness control information in a PWM signal or a brightness control data, selecting and normalizing either the PWM signal or the brightness control data into an external brightness adjusting gain, analyzing a received video data to detect a peak brightness value, multiplying the peak brightness value by the external brightness adjusting gain to produce a final peak brightness value, adjusting the R/G/B maximum gamma voltage values according to the final peak brightness value, and generating R/G/B reference gamma voltage sets by using the R/G/B maximum gamma voltage values adjusted thus.

12 Claims, 3 Drawing Sheets

(52) U.S. Cl.
CPC ..... *G09G 2320/0633* (2013.01); *G09G 2330/028* (2013.01); *G09G 2360/16* (2013.01)

(56) References Cited

FOREIGN PATENT DOCUMENTS

| | | | |
|---|---|---|---|
| CN | 101414438 | A | 4/2009 |
| JP | 2007-279395 | A | 10/2007 |

* cited by examiner

DEVICE AND METHOD FOR CONTROLLING BRIGHTNESS OF ORGANIC LIGHT EMITTING DIODE DISPLAY

CROSS REFERENCE TO RELATED APPLICATION

This application is a divisional of U.S. patent application Ser. No. 12/886,920, filed on Sep. 21, 2010, which claims the benefit of the Korean Patent Application No. 10-2009-0089639, filed on Sep. 22, 2009, the entire disclosure of each of which is hereby incorporated by reference as if fully set forth herein for all purposes.

BACKGROUND OF THE DISCLOSURE

Field of the Disclosure

The present invention relates to organic light emitting diode (hereafter called as OLED) display devices, and more particularly, to device and method for controlling brightness of an OLED display device and sharing a computer system with a liquid crystal display device.

Discussion of the Related Art

The OLED display device is a self light emitting device which emits a light as an electron and a hole of an organic light emitting layer therein re-couples and is expected to be the next generation display device owing to high brightness, a low driving voltage and possibility of fabrication of an extra-thin device. Each of a plurality of pixels of the OLED display device is provided with an OLED pixel having an organic light emitting layer between an anode and a cathode, and a pixel circuit for driving the OLED pixel, independently. The pixel circuit is provided with a switching transistor, a capacitor, and a driving transistor, principally. The switching transistor charges a data signal to the capacitor in response to a scan pulse, and the driving transistor controls current intensity to be supplied to the OLED pixel according to a data voltage charged to the capacitor for controlling gray scale of the OLED pixel.

The OLED display device is provided with a data driver for sorting a plurality of reference gamma voltages supplied from an external gamma voltage generator into gamma voltages of different gray scales and converting a digital data into an analog data (a current or a voltage signal) by using the gamma voltages of different gray scales.

Opposite to this, the liquid crystal display device, which displays a picture by controlling a light transmissivity of liquid crystals on a light from a back light unit by varying an orientation of the liquid crystals according to the data signal, adjusts brightness of the back light unit according to a user's brightness adjusting signal.

Consequently, due to a difference of the brightness controlling systems of the OLED display device which is the self light emitting device and the liquid crystal display device which is a device that requires an additional light source, there has been difficulty in common use of the liquid crystal display device and the OLED display device in a computer system, such as a notebook computer.

SUMMARY OF THE DISCLOSURE

Accordingly, the present invention is directed to device and method for controlling brightness of an OLED display device.

An object of the present invention is to provide device and method for controlling brightness of an OLED display device which enables brightness both of a liquid crystal display device and an OLED display device in common.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a brightness control device in an OLED display device includes a computer system having either a PWM controller for converting and forwarding external brightness control information into a PWM (Pulse Width Modulation) signal and forwarding the PWM signal or a master for forwarding the brightness control data by using a data communication protocol, a selector for selecting either the PWM signal from the PWM controller or the brightness control data from the master, a normalizer for normalizing the PWM signal or the brightness control data from the selector into an external brightness adjusting gain, a peak brightness value detector for analyzing a video data from the computer system to detect a peak brightness value, a multiplier for multiplying the peak brightness value by the external brightness adjusting gain to produce a final peak brightness value, a maximum gamma voltage adjuster for adjusting R/G/B maximum gamma voltage values according to the final peak brightness value, and a reference gamma voltage generator for generating R/G/B maximum gamma voltage sets by using the R/G/B maximum gamma voltage values from the maximum gamma voltage adjuster.

The normalizer normalizes a preset optical compensation parameter into an optical compensation gain according to an optical characteristic of the picture display unit, and forwards the optical compensation gain to the multiplier, and the multiplier multiplies the peak brightness value, the external brightness adjusting gain and the optical compensation gain to produce a final peak brightness value.

In another aspect of the present invention, a brightness control device in an OLED display device includes a computer system having either a PWM controller for converting and forwarding external brightness control information into a PWM (Pulse Width Modulation) signal and forwarding the PWM signal or a master for forwarding the brightness control data by using a data communication protocol, a selector for selecting either the PWM signal from the PWM controller or the brightness control data from the master, a normalizer for normalizing the PWM signal or the brightness control data from the selector into an external brightness adjusting gain and a preset optical compensation parameter into a optical compensation gain according to an optical characteristic of a picture display unit, a peak brightness value detector for analyzing a video data from the computer system to detect a peak brightness value, a first multiplier for multiplying the peak brightness value by the external brightness adjusting gain to produce a final peak brightness value, a maximum gamma voltage adjuster for adjusting R/G/B maximum gamma voltage values according to the final peak brightness value for the first time, a second multiplier for multiplying the R/G/B maximum gamma voltage values adjusted thus by the external brightness adjusting gain to adjust the R/G/B maximum gamma voltage values for the second time, and a reference gamma voltage generator for generating R/G/B maximum gamma voltage sets by using the R/G/B maximum gamma voltage values from the second multiplier.

The brightness control device further includes a PWM extractor for extracting a duty ratio from the PWM signal from the PWM controller, and a slave for storing the brightness control data from the master to a built-in register according to an address and a command code transmitted with the brightness control data, wherein the normalizer normalizes the duty ratio from the selector or the brightness control data from the built in register through the selector into the external brightness adjusting gain having a range of 0~1.

The built in register stores the optical compensation parameter and the brightness control data, and the brightness control device further includes an external memory for keeping the data stored at the built in register even if power is turned off.

The brightness control device further includes a digital to analog converter for converting the R/G/B maximum gamma voltage values from the maximum gamma voltage adjuster into analogous gamma voltages and supplying the analogous gamma voltages to the reference gamma voltage generator.

The digital to analog converter is built-in a power source unit which generating the R/G/B maximum gamma voltages.

The master and the slave uses one of SMBus, $I_2C$, and SPI communication protocols.

The computer system is used with a liquid crystal display device in common, and the PWM controller or the master controls a back light unit in the liquid crystal display device.

In another aspect of the present invention, a method for controlling brightness of an OLED display device includes the steps of forwarding external brightness control information as a PWM signal or a brightness control data, selecting and normalizing either the PWM signal or the brightness control data into an external brightness adjusting gain, analyzing a received video data to detect a peak brightness value, multiplying the peak brightness value by the external brightness adjusting gain to produce a final peak brightness value, adjusting the R/G/B maximum gamma voltage values according to the final peak brightness value, and generating R/G/B reference gamma voltage sets by using the R/G/B maximum gamma voltage values adjusted thus.

The method further includes the step of normalizing a preset optical compensation parameter into an optical compensation gain according to an optical characteristic of a picture display unit, and the peak brightness value, the external brightness adjusting gain, and the optical compensation gain are multiplied to produce the final peak brightness value.

In another aspect of the present invention, a method for controlling brightness of an OLED display device includes the steps of forwarding external brightness control information in a PWM signal or a brightness control data, selecting and normalizing either the PWM signal or the brightness control data into an external brightness adjusting gain, normalizing a preset optical compensation parameter into an optical compensation gain according to an optical characteristic of a picture display unit, analyzing a received video data to detect a peak brightness value, multiplying the peak brightness value by the optical compensation gain to produce a final peak brightness value, adjusting the R/G/B maximum gamma voltage values according to the final peak brightness value for the first time, multiplying the R/G/B maximum gamma voltage values by the external brightness gain to adjust the R/G/B maximum gamma voltage values for the second time, and generating R/G/B reference gamma voltage sets by using the R/G/B maximum gamma voltage values adjusted for the second time.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
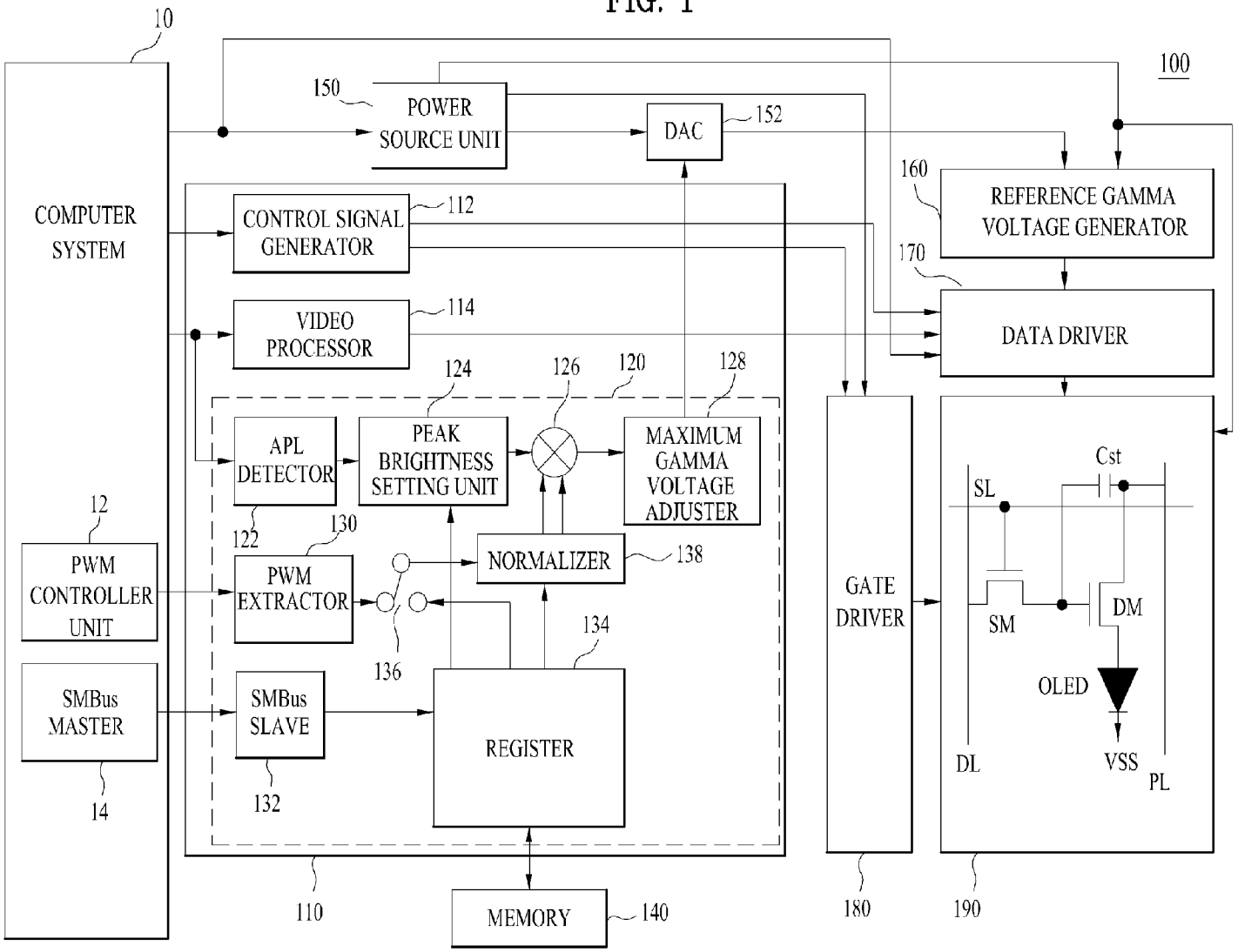
FIG. 1 illustrates a block diagram of a brightness controller in an OLED display device in accordance with a preferred embodiment of the present invention.

FIG. 1 illustrates a block diagram of a brightness controller in an OLED display device in accordance with a preferred embodiment of the present invention.

Referring to FIG. 1, the OLED display device 100 is driven connected to an external computer system 10. That is, the computer system 10 supplies driving power VCC, a video data, a plurality of synchronizing signals required for driving the OLED display device, and supplies a brightness adjusting signal for adjusting brightness of the OLED display device according to user's brightness control.

The computer system 10 has a PWM controller 12 for generating a PWM (Pulse Width Modulation) signal of which duty ratio varies with the user's brightness control and forwarding the PWM signal as the brightness adjusting signal. Different from this, the computer system 10 may have an SMBus master 14 for forwarding a brightness control data according to the user's brightness control and brightness control information including address information and a command code in an SMBus (System Management Bus) communication system. Moreover, the computer system 10 can forward the brightness control information by using, not only the SMBus communication protocol, but also $I_2C$, SPI, and so on communication protocol. Hereafter, only a case when the SMBus communication protocol is used will be described, as an example.

For convenience sake, though FIG. 1 illustrates that the computer system 10 includes both the PWM controller 12 and the SMBus master 14, the computer system 10 includes either the PWM controller 12 or the SMBus master 14, actually. In a case the computer system 10 drives the liquid crystal display device (not shown), the PWM signal from the PWM controller 12 or the brightness control information from the SMBus master 14 is supplied to a back light driving unit which drives the back light unit of the liquid crystal display device for controlling a light emission time and/or a driving voltage of the back light unit to control the brightness of the back light, i.e., the brightness of the liquid crystal display device. Moreover, the computer system 10 can drive the OLED display device 100 shown in FIG. 1.

The OLED display device 100 includes a timing controller 110, a memory 140, a power source unit 150, a reference gamma voltage generator 160, a data driver 170, a gate driver 180, and a picture display unit 190.

The base driving voltage VCC is supplied from a power source unit (not shown) of the computer system 10 to the power source unit 150 as well as to the timing controller 110, the memory 140 and the data driver 170 as a digital driving voltage DVDD. The power source unit 150 transforms the base driving voltage VCC into an analog driving voltage AVDD and supplies the analog driving voltage AVDD to the reference gamma voltage generator 160 and the data driver 170. Also, the power source unit 150 generates a gate high voltage VGH and a gate low voltage VGL by charge pumping the base driving voltage VCC and supplies the gate high voltage VGH and the gate low voltage VGL to the gate driver 180. A charge pump circuit which generates the gate high voltage VGH and the gate low voltage VGL may be formed separate from the power source unit 150.

The timing controller 110 includes a generator 112, a video processing unit 114, and a brightness controller 120.

The generator 112 generates and forwards a plurality of control signals for controlling driving timings of the data driver 170 and the gate driver 180 by using at least two synchronizing signals including a dot clock, a data enable, a vertical synchronizing signal, a horizontal synchronizing signal from the computer system 10.

The video processing unit 114 aligns video data suitable to a picture display unit 170 from the computer system 10 and forwards the video data to the data driver 170. The video processing unit 114 also modulates received video data by a variety of data modulation methods for improvement of a picture quality and so on and forwards the video data to the data driver 170.

The brightness controller 120 adjusts brightness according to a received data for reduction of power consumption and optical compensation, as well as an external brightness adjusting signal from the computer system 10, and forwards a final brightness data adjusted thus to a DAC 152 in the power source unit 150.

The brightness controller 120 includes a peak brightness detector having an average pixel level (APL) detector 122 of the computer system 10 and a peak brightness setting unit 124, a PWM extractor 130, an SMBus slave 132, a register 134, a selector 136, a normalizer 138, a multiplier 126, and a maximum gamma voltage adjuster 128.

The APL detector 122 in the peak brightness detector analyzes the video data from the computer system 10 at least in frame units for detecting an APL value. The APL value denotes a number of pixels (i.e., an area occupied by white pixels in a frame) having peak brightness in one frame.

The peak brightness setting unit 124 in the a peak brightness detector determines a peak brightness value (%) according to the APL value from the APL detector 122 by using a preset APL function and forwards the peak brightness value (%). The peak brightness setting unit 124 has an APL function set in advance for determining an APL curve as shown in FIG. 2A based on an APL curved data built-in the register 134. The APL function can be adjusted according to the APL curve data stored in the register 134. The peak brightness setting unit 124 determines and forwards a peak brightness value according to the APL value analyzed by using the preset APL function. The peak brightness setting unit 124 can select and forward the peak brightness value according to the APL value detected by using an LUT having the peak brightness value mapped thereon according to the preset APL value.

The PWM extractor 130 extracts and forwards a duty ratio % between 0~100% which is a pulse width of a PWM signal if the PWM extractor 130 receives the PWM signal from the PWM controller 12 in the computer system 10 for adjusting an external brightness adjustment.

The SMBus slave 132 stores a brightness control data to a relevant address of the register 134 according to an address and a command code included in brightness control information if the SMBus slave 132 receives the brightness control information from the SMBus master 132 in the computer system 10. For an example, the brightness control information supplied from the SMBus master 14 to the SMBus slave 132 can be 8 bit or 16 bit data.

The register 134 stores the brightness control data from the SMBus slave 132, the APL curve data from the peak brightness setting unit 124 for setting the APL function, and the optical compensation parameters for compensating for a panel deviation caused by an optical characteristic of the picture display unit 190. The data stored in the register 134 is stored in an external memory 140, such as EEPROM in advance, and if the OLED display device 100 is turned on, the data stored thus is read from the external memory 140 by means of the $I_2C$ communication and stored in the register 134. Particularly, since the brightness control data stored in the register 140 through the SMBus slave 132 is stored in the external memory 140, the user can keep the brightness control data even if the OLED display device 100 is turned off.

The selector 136 selects and forwards the duty ratio from the PWM extractor 130 or the brightness control data from the register 134 in response to a control signal which instructs a brightness control method of the computer system 10 to the normalizer 138. In a case the computer system 10 uses the PWM controller 12, the selector 136 selects the duty ratio from the PWM extractor 130 and forwards the duty ratio to the normalizer 138 in response to a control signal which instructs the computer system 10 to use the PWM controller 12. Different from this, in a case the computer system 10 uses the SMBus master 14, the selector 136 selects the brightness control data from the register 134 and forwards the brightness control data to the normalizer 138 in response to a control signal which instructs the computer system 10 to use the SMBus master 14.

The normalizer 138 receives an optical compensation parameter from the register 134, calculates an optical compensation gain by the following equation 1 with a first calculation unit (not shown) built therein, and forwards the optical compensation gain (0.5~1.5) calculated thus to the multiplier 124.

$$\text{Optical compensation gain}=(\text{optical compensation parameter}+128)/256=0.5\sim1.5 \quad (1),$$

where the optical compensation parameter has 8 bits.

Along with this, upon reception of the duty ratio from the PWM extractor 130 through the selector 136, the normalizer 138 normalizes the duty ratio into a 0~1 external brightness gain by using a second calculation unit (not shown) and forwards the external brightness gain to the multiplier 124.

And, upon reception of the brightness control data from the register 134 through the selector 136, the normalizer 138 calculates the external brightness gain by the following equation 2 with a third calculation unit (not shown) built therein and forwards the external brightness gain (0.004~1) calculated thus to the multiplier 124.

$$\text{External brightness adjustment gain}=(\text{brightness control data}+1)/256=0.5\sim1.5 \quad (2),$$

where the brightness control data has 8 bits.

The multiplier 124 multiplies all the peak brightness value from the peak brightness setting unit 124, the optical compensation gain and the external brightness gain from the normalizer 138 to produce a final peak brightness value and forwards the final peak brightness value to the maximum gamma voltage adjuster 128.

The maximum gamma voltage adjuster 128 selects and forwards maximum gamma data on each of R, G, B according to the final peak brightness value from the multiplier 124. By using a look-up table having the maximum gamma data on each of R, G, B mapped thereon according to different final peak brightness value, the maximum gamma voltage adjuster 128 selects the maximum gamma data on each of R, G, B for the final brightness value from the look-up table and forwards the maximum gamma data to a digital-to-analog converter (hereafter DAC) 152.

Thus, by adjusting R/G/B maximum gamma voltages according to the final peak brightness value produced by multiplying all the peak brightness value produced by analyzing the received data, the optical compensation gain and the external adjustment gain, the brightness controller 120 adjusts brightness of the OLED display device 100.

The DAC 152 converts the R/G/B maximum gamma voltage data from the brightness controller 120 of the timing controller 110 into analogous R/G/B maximum gamma voltages and forwards to the reference gamma voltage generator 160.

Figure 2:
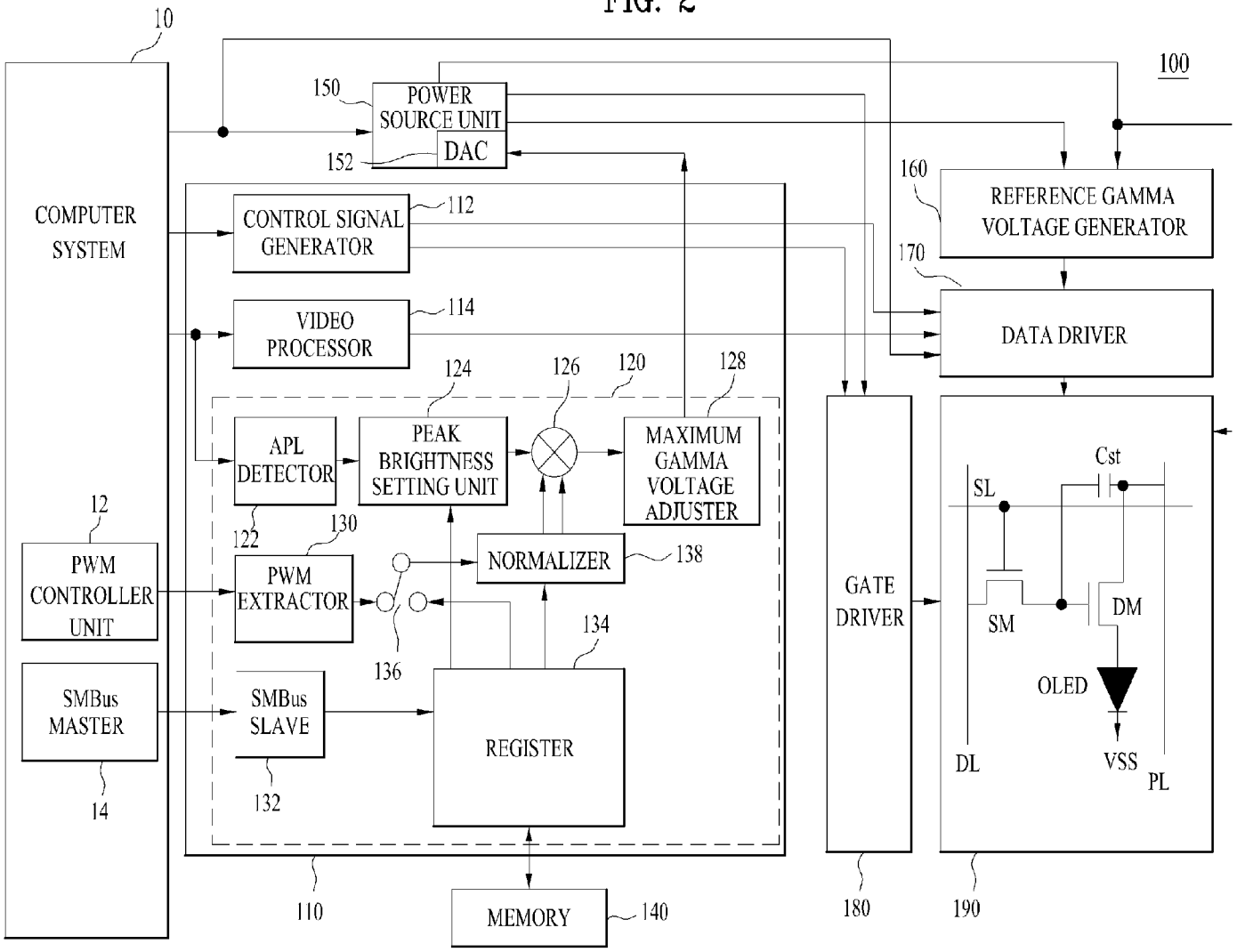
FIG. 2 illustrates a block diagram of a brightness controller in an OLED display device in accordance with another preferred embodiment of the present invention.

Referring to FIG. 2, the DAC 152 may be built in the power source unit 150 to form a power source chip. As shown in FIG. 2, if the DAC 152 is built in the power source unit 150, the timing controller 110 supplies the R/G/B maximum gamma voltage data according to the peak brightness value from the brightness controller 120 to the DAC 152 of the power source unit 150 by $I_2C$ communication method, and the DAC 152 converts the R/G/B maximum gamma voltage data to the analogous R/G/B maximum gamma voltages and forwards to the reference gamma voltage generator 160.

The reference gamma voltage generator 160 generates and forwards different reference gamma voltage sets on each of the R/G/B to the data driver 170. The reference gamma voltage generator 160 has R/G/B resistance strings connected in series to R/G/B maximum gamma voltage input terminals. The R resistance string divides the R maximum gamma voltage from the DAC 152 to produce R reference gamma voltage sets including a plurality of R reference gamma voltage and forwards the R reference gamma voltage sets to the data driver 170. The G/B resistance strings divide the G/B maximum gamma voltages from the DAC 152 to produce G/B reference gamma voltage sets and forwards the G/B reference gamma voltage sets to the data driver 170. For an example, each of the R/G/B reference gamma voltage sets has 7 or 11 reference gamma voltages.

The data driver 170 converts a video data from the timing controller 110 into analogous data signal in response to a control signal from the timing controller 110 and forwards to a plurality of data lines DL in the picture display unit 170. In this instance, the data driver 170 sub-divides the R/G/B reference gamma voltage sets from the reference gamma voltage generator 160 into gamma voltages corresponding to gray scale values of the R/G/B video data, and converts the R, G, B video data into analogous data signals by using the R/G/B maximum gamma voltage sets sub-divided thus.

The gate driver 180 drives the plurality of gate lines GL in the picture display unit 190 in succession in response to a control signal from the timing controller 110. For an example, if the transistors in the picture display unit 190 are PMOS transistors, the gate driver 180 supplies a gate low voltage which is a gate turn on voltage in a scan period in which the gate lines are driven and a gate high voltage which is a gate turn off voltage in other period. Different from this, if the transistors in the picture display unit 190 are NMOS transistors, the gate high voltage supplies the gate turn on voltage and the gate low voltage supplies the gate turn on voltage.

The picture display unit 190 has a plurality of R/G/B sub-pixels PXL connected to the data lines DL, the gate lines GL, and the power lines PL, respectively. Each of the sub-pixels PXL includes switching and driving transistors SM and DM and one capacitor Cst for driving the OLED device. The switching and driving transistors SM and DM are PMOS and NMOS transistors. As the switching transistor SM is turned on by the gate turn on voltage supplied to the gate line DL, the data signal supplied to the data line DL is charged to the capacitor C as a difference voltage of the driving voltage VDD and the data signal. The driving transistor DM supplies a driving current according to the difference voltage charged to the capacitor to make the OLED device to emit a light displaying a gray scale proportional to the driving current.

Thus, in order to make the liquid crystal display device and the computer system 10 to be used in common, the OLED display device 100 shown in FIGS. 1 and 2 selects the external brightness control information (the PWM signal or the SMBus brightness control data) supplied from the computer system 10 according to a brightness control method of the computer system 10, and normalizes the brightness control information selected thus into the external brightness adjusting gain value. Then, all of the external brightness adjusting gate values are multiplied by the peak brightness value and the optical compensation gain value to produce a final peak brightness value, and the R/G/B maximum gamma voltages are adjusted according to the final peak brightness value produced thus to adjust the brightness of the OLED display device.

Figure 3:
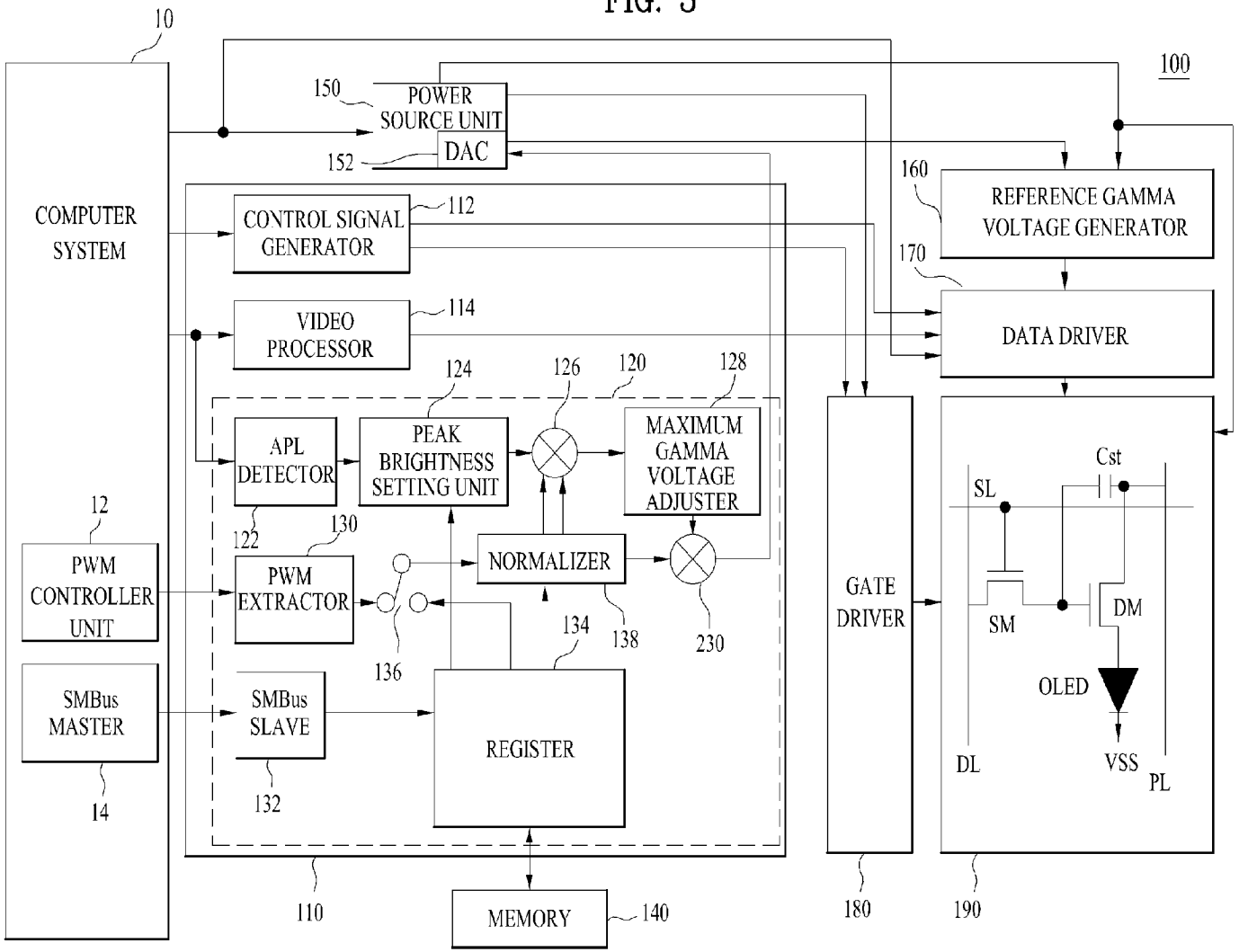
FIG. 3 illustrates a block diagram of a brightness controller in an OLED display device in accordance with another preferred embodiment of the present invention.

FIG. 3 illustrates a block diagram of a brightness controller in an OLED display device in accordance with another preferred embodiment of the present invention.

Referring to FIG. 3, in comparison to the OLED display device in FIG. 1, since the OLED display device is different in that a second multiplier 230 is provided thereto additionally for multiplying the R/G/B maximum gamma voltage data from the maximum gamma voltage adjuster 228 by the external brightness adjusting gain from the normalizer 238, description of identical parts will be omitted.

Referring to FIG. 3, the first multiplier 126 multiplies the peak brightness value from the peak brightness setting unit 124 by the optical compensation value from the normalizer 238 to produce a final peak brightness value and forwards the final peak brightness value produced thus to a maximum brightness controller 220.

The maximum brightness controller 220 selects R/G/B maximum gamma voltage data according to the final peak brightness value from the first multiplier 124 and forwards the R/G/B maximum gamma voltage data selected thus.

The second multiplier 230 multiplies the R/G/B maximum gamma voltage data from the maximum brightness controller 220 by the external brightness adjusting gain from the normalizer 238, to adjust the R/G/B maximum gamma voltage values according to external brightness control information to control the brightness of the OLED display device.

Eventually, referring to FIG. 3, in order to make the liquid crystal display device and the computer system 10 to be used in common, the OLED display device 100 selects the external brightness control information (the PWM signal or the SMBus brightness control data) supplied from the computer system 10 according to a brightness control method of the computer system 10, and normalizes the brightness control information selected thus into the external brightness adjusting gain value. Then, by selecting the R/G/B maximum gamma voltages according to the final peak brightness value produced by multiplying the peak brightness value by the optical compensation gain, and by multiplying the R/G/B maximum gamma voltages by the external brightness adjusting gain values, the R/G/B maximum gamma voltage values are adjusted according to the brightness control information, to adjust the brightness of the OLED display device.

Thus, in order to make the liquid crystal display device and the computer system to be used in common, the device and method for controlling brightness of an OLED display device of the present invention normalizes the brightness control information (A PWM signal or an SMBus/$I_2C$/SPI communication protocol brightness control data) into the external brightness adjusting gain value. Then, a final peak brightness value is produced by multiplying all of the external brightness adjusting gain values normalized thus by the peak brightness value and optical compensation gain value, and the R/G/B maximum gamma voltages are adjusted according to the final peak brightness value produced thus, to adjust the brightness of the OLED display device.

Or, alternatively, the device and method for controlling brightness of an OLED display device of the present invention selects the R/G/B maximum gamma voltage values according to the final peak brightness value produced by multiplying the peak brightness value by the optical compensation gain, and by multiplying the R/G/B maximum gamma voltage values by the normalized external brightness adjusting gain value, the R/G/B maximum gamma voltages are adjusted according to the brightness control information, to adjust the brightness of the OLED display device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A brightness control device in an OLED display device comprising:

a computer system having either a PWM controller for converting and forwarding external brightness control information into a PWM (Pulse Width Modulation) signal and forwarding the PWM signal or a master for forwarding the brightness control data by using a data communication protocol;

a selector for selecting either the PWM signal from the PWM controller or the brightness control data from the master;

a normalizer for normalizing the PWM signal or the brightness control data from the selector into an external brightness adjusting gain and a preset optical compensation parameter into a optical compensation gain according to an optical characteristic of a picture display unit;

a peak brightness value detector for analyzing a video data from the computer system to detect a peak brightness value;

a first multiplier for multiplying the peak brightness value by the external brightness adjusting gain to produce a final peak brightness value;

a maximum gamma voltage adjuster for adjusting R/G/B maximum gamma voltage values according to the final peak brightness value for the first time;

a second multiplier for multiplying the R/G/B maximum gamma voltage values, adjusted by the maximum gamma voltage adjuster, by the external brightness adjusting gain to adjust the R/G/B maximum gamma voltage values for the second time; and a reference gamma voltage generator for generating R/G/B reference gamma voltage sets by using the R/G/B maximum gamma voltage values from the second multiplier.

2. The brightness control device according to claim 1, further comprising:

a PWM extractor for extracting a duty ratio from the PWM signal from the PWM controller; and a slave for storing the brightness control data from the master to a built-in register according to an address and a command code transmitted with the brightness control data, wherein the normalizer normalizes the duty ratio from the selector or the brightness control data from the built in register through the selector into the external brightness adjusting gain having a range of 0~1.

3. The brightness control device according to claim 2, wherein the built in register stores the optical compensation parameter and the brightness control data, and the brightness control device further includes an external memory for keeping the data stored at the built in register even if power is turned off.

4. The brightness control device according to claim 2, wherein the master and the slave uses one of SMBus, $I_2C$, and SPI communication protocols.

5. The brightness control device according to claim 1, further comprising a digital to analog converter for converting the R/G/B maximum gamma voltage values from the maximum gamma voltage adjuster into analogous gamma voltages and supplying the analogous gamma voltages to the reference gamma voltage generator.

6. The brightness control device according to claim 5, wherein the digital to analog converter is built-in a power source unit which generating the R/G/B maximum gamma voltages.

7. The brightness control device according to claim 1, wherein the computer system is used with a liquid crystal display device in common, and the PWM controller or the master controls a back light unit in the liquid crystal display device.

8. The brightness control device according to claim 1, wherein:

the computer system is used for both the OLED display device and a liquid crystal display device;

when the computer system drives the OLED display device, the PWM controller or the master controls the R/G/B maximum gamma voltage values for the reference gamma voltage generator; and when the computer system drives the liquid crystal display device, the PWM controller or the master controller a backlight unit in the liquid crystal display device.

9. A method for controlling brightness of an OLED display device, the method comprising:

forwarding external brightness control information in a PWM signal or a brightness control data;

selecting and normalizing either the PWM signal or the brightness control data into an external brightness adjusting gain;

normalizing a preset optical compensation parameter into an optical compensation gain according to an optical characteristic of a picture display unit;

analyzing a received video data to detect a peak brightness value;

multiplying the peak brightness value by the optical compensation gain to produce a final peak brightness value;

adjusting R/G/B maximum gamma voltage values according to the final peak brightness value for the first time;

multiplying the R/G/B maximum gamma voltage values, adjusted according to the final peak brightness value, by the external brightness gain to adjust the R/G/B maximum gamma voltage values for the second time; and generating R/G/B reference gamma voltage sets by using the R/G/B maximum gamma voltage values adjusted for the second time.

10. The method according to claim 9, further comprising the step of converting the R/G/B maximum gamma voltage values into gamma voltages before the R/G/B maximum gamma voltage sets are generated.

11. The method according to claim 9, wherein:

the PWM signal or the brightness control data is supplied from a computer system, which is used for both the OLED display device and a liquid crystal display device;

when the computer system drives the OLED display device, the PWM signal or the brightness control data controls the R/G/B maximum gamma voltage values for the generating the R/G/B reference gamma voltage sets; and when the computer system drives the liquid crystal display device, the PWM signal or the brightness control data control a backlight unit in the liquid crystal display device.

12. The method according to claim 9, further comprising:

extracting a duty ratio from the PWM signal;

storing the brightness control data to a built-in register according to an address and a command code transmitted with the brightness control data; and normalizing the duty ratio or the brightness control data from the built-in register into the external brightness adjusting gain having a range of 0~1.

* * * * *